United States Patent [19]

Diamond

[11] Patent Number: 4,703,575

[45] Date of Patent: Nov. 3, 1987

[54] MAGNETIC SIGN MOUNT

[75] Inventor: Israel Diamond, Franklin Square, N.Y.

[73] Assignee: Merchandising Display Corporation, Englewood, N.J.

[21] Appl. No.: 781,664

[22] Filed: Sep. 30, 1985

[51] Int. Cl.[4] ..... G09F 7/04

[52] U.S. Cl. ..... 40/600; 40/13; 40/617; 40/621; 211/DIG. 1

[58] Field of Search ..... 40/617, 600, 11 R, 16.4, 40/621, 13; 24/487, 67 R; 248/467; 211/DIG. 1

[56] References Cited

U.S. PATENT DOCUMENTS

| | | | |
|---|---|---|---|
| 2,815,595 | 12/1957 | Davis | 40/16.4 |
| 3,324,585 | 6/1967 | Frederickson | 40/11 R |
| 3,350,045 | 10/1967 | Mayers | 248/467 |
| 4,222,489 | 9/1980 | Hutter | 211/DIG. 1 |
| 4,255,837 | 3/1981 | Holtz | 24/67 R |
| 4,258,493 | 3/1981 | Kettlestrings et al. | 40/617 |
| 4,475,300 | 10/1984 | Ledenican | 40/600 |
| 4,524,992 | 6/1985 | Linn | 24/487 |
| 4,557,064 | 12/1985 | Thompson | 40/617 |

*Primary Examiner*—Robert Peshock

*Assistant Examiner*—Cary E. Stone

*Attorney, Agent, or Firm*—Natter & Natter

[57] ABSTRACT

A suspended sign display includes rigid front and rear leaves hinged together adjacent their upper edges. The rear leaf includes a device for attachment to a supporting surface such as a store window. The leaves are held folded together by a magnet which is secured to the inner face of each leaf. An indicia bearing placard sign is clamped between the magnets. An abutment projects from the rear leaf to assist in positioning the placard. The outer face of the front leaf includes additional sign indicia either directly imprinted on the leaf or on a card carried by the leaf, and the outer face of the rear leaf may also include sign indicia. In one embodiment, each leaf is a separate extrusion having a grooved channel along its upper edge. A separate hinge extrusion is engaged in each of the channels. In an alternate embodiment the mount is formed as a single extrusion, and the device for attaching the mount to a supporting surface includes a pair of diverging webs which clip to a shelf edge molding. In a further embodiment the upper edge of one leaf includes a sleeve and the upper edge of the other leaf includes a rod seated in the sleeve to provide a hinge.

15 Claims, 8 Drawing Figures

FIG. 4
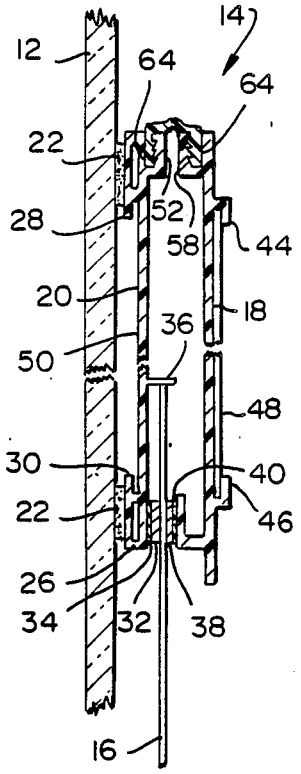
FIG. 5
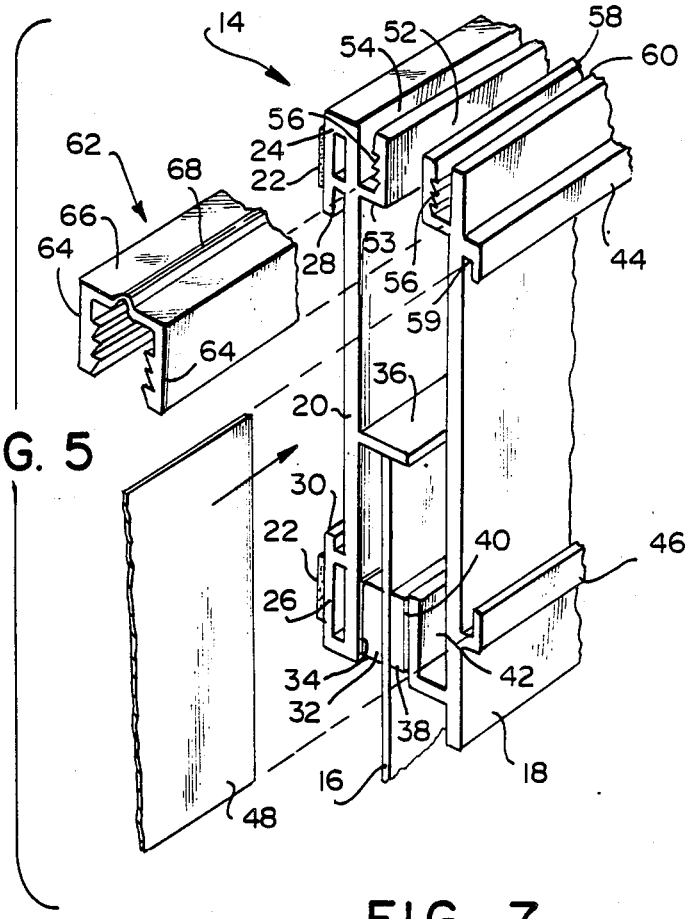
FIG. 7
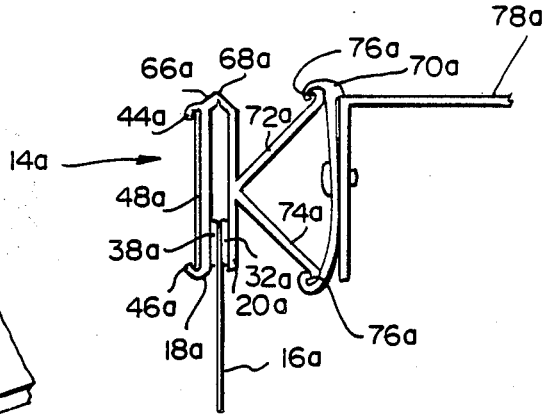
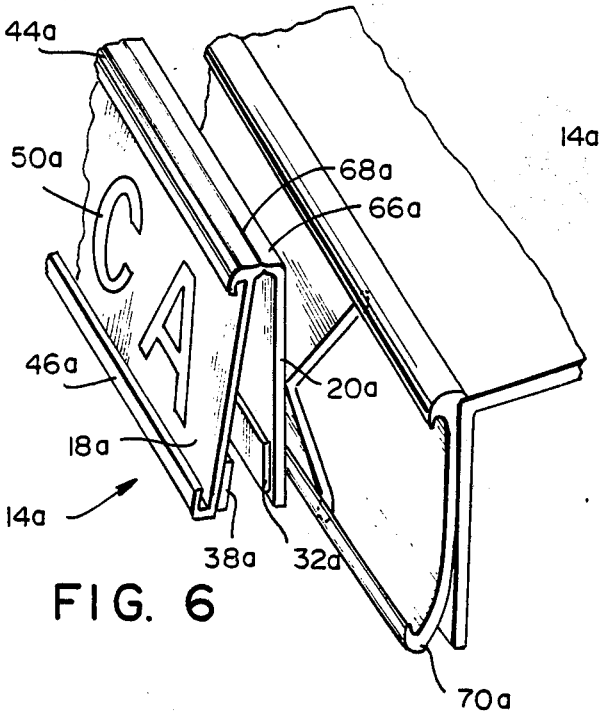
FIG. 6
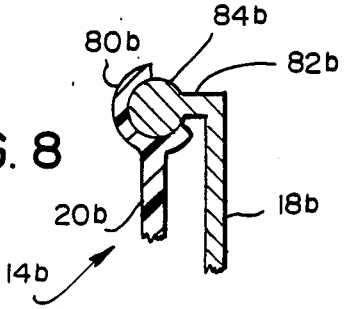
FIG. 8

MAGNETIC SIGN MOUNT

FIELD OF THE INVENTION

This invention relates generally to placard mounts and more particularly to magnetic mounts for suspending placards in retail environments.

BACKGROUND ART

Retail establishments such as supermarkets and the like have for many years attracted customers by offering weekly specials or sale items at reduced prices and advertising such items on paperboard or paper placards mounted to the store windows. The placards were ephemeral, being generally displayed for no longer that one or two weeks.

Many systems have heretofore been employed for mounting such placards. The use of tape to mount the placards to the window was accompanied by significant disadvantages. The tape left residue on the windows necessitating arduous cleaning. Employees encountered difficulty in mounting the placards in proper vertical position, especially when the window locations were relatively high and ladders or other devices were required. Often, two placards were placed in back-to-back relationship so that the same offering was visible to both prospective purchasers outside and inside the store premises. Extensive difficulties were therefore encountered in aligning and registering back-to-back placards while mounting them to the store windows.

In addition, the use of tape to mount placards in store windows resulted in unsightly and often irregularly shaped pieces of mounting tape.

Attempts to provide alternate devices for mounting placards, including the use of suspended wires, also resulted in an unsightly appearance and did not facilitate the rapid and neat mounting of frequently changed placards.

In U.S. Pat. No. 4,258,493 a display support for holding signs was disclosed. The support included a folded over flexible backing band. A pressure sensitive adhesive layer was utilized to mount the band to a store window and the band was folded over to carry a sign between a pair of magnets mounted to the inner faces of the band. While this device did serve to provide a magnetic mount for replaceable signs, it did not gain widespread acceptance due to a variety of factors. Initially, the appearance presented from the outside of the window was unsightly, and the pressure sensitive adhesive layer was visually exposed and its function evident, apparent and unconcealed.

The folded over band was subject to cracks and failure due to fatigue after repeated usage. In addition, if a portion of the band were utilized to carry indicia, the band was so configured that the indicia on the support detracted from the usable area of any sign which was being supported between the magnets. Thus, to fully utilize a rectangular sign area, consideration as to the space required by the folded over band must be taken in account and, in addition, a proper correlation between any indicia on the band and indicia on the suspended sign was required.

DISCLOSURE OF THE INVENTION

In compendium, the present invention comprises a sign mount comprising one or more plastic extrusions cut to a length for accommodating placards of a desired size. The extrusions are formed into a front and rear leaf which are hinged together. A magnet is mounted to the inner face of each leaf adjacent its lower edge. A placard is clamped between the magnets when the leaves are folded together. To assist in positioning the placard, an abutment projects from the inner face of the rear leaf and is engaged by the top edge of the placard. Permanent or semipermanent sign indicia is imprinted directly on the outer faces of the leaves or carried on a card mounted to the leaves.

Each leaf is formed of a separate extrusion of, for example, rigid polyvinylchloride, ultraviolet stable styrene, ABS or like material having a channel along its upper edge. A separate polypropylene hinge extrusion is cut to a length mating the length of the leaves and is engaged in the channels.

In an alternate embodiment, a single extrusion may be employed with the rear leaf including a pair of unitary webs adapted to clip into a shelf edge molding.

A further embodiment includes a hinge comprising a split cylindrical sleeve formed along the upper edge of one leaf extrusion and a cylindrical rod formed along the upper edge of the other leaf extrusion. The rod is slid into the sleeve through one open end and the slit area of the sleeve facilitates rotation of one leaf relative to the other.

In all embodiments, the leaves are configured to provide a relatively rigid member capable of carrying additional sign indicia on its face.

From the foregoing compendium it will be appreciated that it is an aspect of the present invention to provide a magnetic display mount of the general character described which is not subject to the disadvantages of the background art aforementioned.

It is a further aspect of the present invention to provide a magnetic display mount of the general character described which facilitates rapid mounting and changing of placards by relatively unskilled personnel.

It is a further feature of the present invention to provide a magnetic display mount of the general character described which is comprised of extruded members to provide simplified construction and versatility for any size placard.

A further feature of the present invention is to provide a magnetic display mount of the general character described which includes a pair of leaf extrusions having a unitary hinge formed by an interfitting sleeve and rod.

Another consideration of the present invention is to provide a magnetic display mount of the general character described which is durable and capable of long term usage without being subject to fatigue failure.

A further feature of the present invention is to provide a magnetic display mount of the general character described which presents a pleasing visual appearance and maximizes the promotional space available for display purposes.

Yet another aspect of the present invention is to provide a magnetic display mount of the general character described suitable for mounting a placard and which provides additional display surfaces which do not detract from usable placard display area.

A further consideration of the present invention is to provide a magnetic display mount of the general character described which is low in cost and suitable for economical mass production fabrication.

Another feature of the present invention is to provide a magnetic display mount of the general character described which includes an abutment stop to facilitate true vertical mounting of placard signs by unskilled personnel.

With these ends in view, the invention finds embodiment in various combinations of elements, series of steps and arrangement of parts by which the said features, aspects, and considerations and certain other features, aspects, and considerations are hereinafter attained, all as more fully described with reference to the accompanying drawings and the scope of which is more particularly pointed out and indicated in the appended claims.

BRIEF DESCRIPTION OF THE DRAWINGS

In the accompanying drawings in which are shown some of the various possible exemplary embodiments of the invention:

FIG. 4 is an enlarged, fragmentary sectional view through the magnetic display mount, the same being taken substantially along the plane 4—4 of FIG. 2 and showing the placard suspended between the magnets;

FIG. 5 is an enlarged exploded perspective view of the magnetic display mount and illustrating the manner in which a rigid front and rear leaf of the mount are assembled together with a hinge extrusion;

FIG. 6 is a fragmentary perspective illustration of a further embodiment of the invention wherein the mount is formed of a single extrusion which clips to a shelf edge molding for vertical support;

FIG. 7 is an auxiliary end view of the magnetic display mount illustrated in FIG. 6; and FIG. 8 is an enlarged fragmentary sectional view through a further embodiment of the invention similar to the sectional view of FIG. 4 wherein the hinge is formed as part of the front and rear leaves.

DESCRIPTION OF THE PREFERRED EMBODIMENTS

Figure 1:
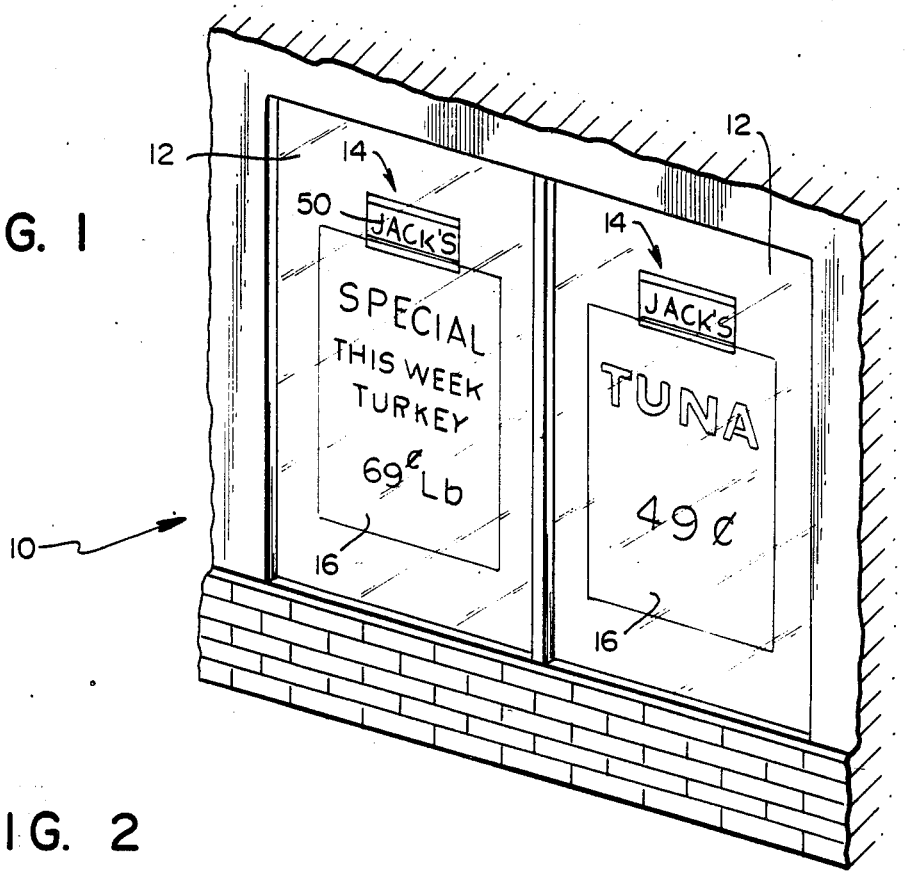
FIG. 1 is an exterior perspective view of a retail store front and showing windows having placards supported by magnetic display mounts constructed in accordance with and embodying the invention.

Referring now in detail to the drawings, illustrated in FIG. 1 is a typical store front 10 which includes a plurality of large display windows 12. Secured to the interior surface of the windows 12 in a manner to be hereinafter described are a pair of magnetic sign mounts denoted generally by the reference numeral 14 and constructed in accordance with and embodying the present invention. Each sign mount 14 is illustrated as suspending a placard sign 16 formed of paperboard, paper or other sheet material and which includes advertising indicia drawn or imprinted thereon.

The magnetic sign mount 14 is formed with a relatively rigid extruded plastic front leaf 18, the outer face of which is exposed and viewable when facing the display window 12 from the inside and a relatively rigid extruded plactic rear leaf 20 positioned adjacent and adhered to the display window 12, the outer face of which is viewable from the outside.

It should be appreciated that the placard desirably includes advertising indicia on both of its faces for viewing from either side of the window 12. In the event advertising indicia appears only on one side, a pair of placards 16 may be positioned in back-to-back relationship and suspended from the magnetic sign mount 14.

As previously mentioned the rear leaf 20 is adhered to the display window 12. For such purpose one or more strips of double faced adhesive tape such as foamed tape 22 or the like are secured to a pair of generally planar elongate mounting platforms 24, 26 which project from the outer face of the leaf 20 adjacent its upper and lower edges respectively. The tape 22 is secured to the platforms 24, 26, and thereafter the sign mount 14 is attached to a supporting surface such as a window 12 by removing a release layer and thereafter forcing the adhesive tape 22 against the supporting surface.

The upper and lower mounting platforms 24, 26 include lip extensions 28, 30, respectively, which project toward one another and are spaced from the generally planar leaf 20 to provide a pair of spaced parallel grooves for accommodating an optional card sign having imprinted advertising indicia. A relatively rigid cardboard, plastic or metal sheet may be utilized for the card.

A magnet strip 32 is adhered along the inner face of the rear leaf 20 adjacent its lower edge and in approximate registry with the lower mounting platform 26. Any suitable adherent may be employed, such as a layer of adhesive 34 or rivets, clips, etc.

As may be readily observed in FIGS. 4 and 5, for the purpose of assisting in the placement of a placard 16, an elongate abutment rib 36 projects from the inner face of the rear leaf 20 in a generally horizontal plane from a position above the magnet strip 32. The top ege of the placard 16 is positioned against the abutment rib 36 when suspending the placard.

Mounted to the front leaf 18 in registry with the magnet strip 32 is a front leaf magnet strip 38. The magnet strip 38 is adhered to the inner surface of the front leaf 18 through the use of a suitable adhesive 40 or any other conventional means which secures the strip 38 to an upturned leg of a bracket 42. The bracket 42 projects from the front leaf toward the rear leaf 20. It should be noted that the bottom edge of the front leaf 18 extends below the bracket 42 to provide a suitable finger grip surface for separating the leaves 18, 20 to open the mount and remove or insert a placard.

A pair of elongate lips 44, 46 extend from the outer face of the front leaf 18 adjacent its upper and lower edges, respectively. Carried between grooves formed by the facing lips 44, 46 is a suitable advertising card sign 48 having indicia. As with the optional card sign of the rear leaf, the card 48 is formed of relatively rigid material such as cardboard, plastic or metal sheet.

Figure 2:
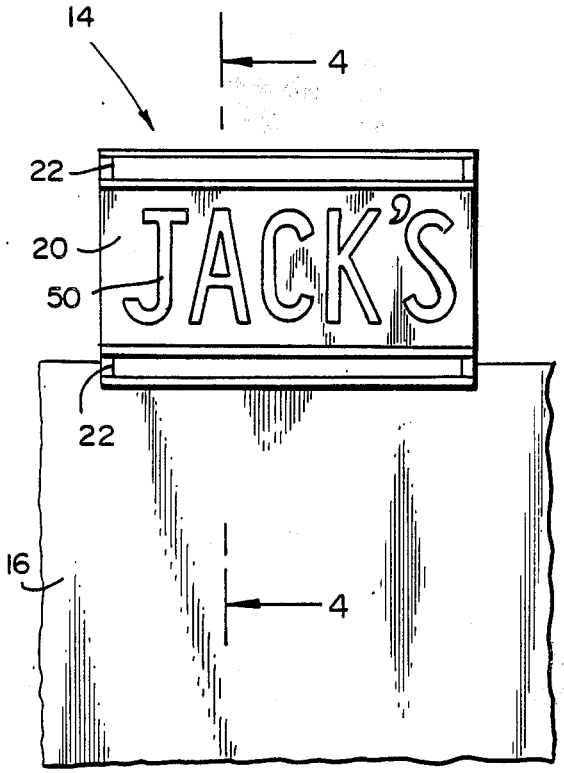
FIG. 2 is an enlarged, fragmentary, front elevational view of the magnetic display mount and a portion of a placard as viewed from the outside of the premises.
Figure 3:
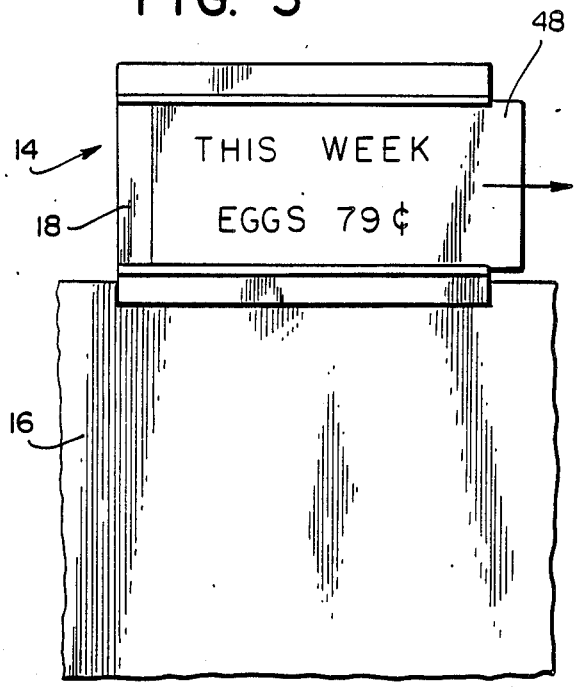
FIG. 3 is an enlarged, fragmentary, front elevational view of the mount and a portion of the placard as viewed from the inside of the premises.

Illustrated in FIGS. 1 and 2 is permanent sign indicia 50 imprinted directly upon the outer face of the rear leaf 20 between the lips 28, 30 of the rear leaf. The indicia 50 may be omitted or covered at the option of the merchant with a suitable card sign which is slid between the lips 28, 30. In addition, the outer face of the front leaf may carry permanent sign indicia printed directly upon the front leaf and the card sign 48 may or may not be employed.

The leaves 18, 20 of the magnetic sign mount 14 are hinged together to facilitate separation of the magnet strips 32, 38 for the purpose of insertion and removal of placards 16. For this purpose, the rear leaf 20 includes an upwardly directed leg 52 adjacent the upper edge of the leaf 20 and which extends in a plane generally parallel to the plane of the leaf, yet being spaced inwardly from the inner face of the leaf. The leg 52 and a bottom web 53 joining the leg to the rear leaf form a channel 54. The channel 54 includes a plurality of downturned ribs 56 on the leg 52. Similarly, the front leaf 18 includes a leg 58 which, together with a web 59 extending between the leg 58 and the front leaf 18, forms a channel 60. The inner wall of the leg 58 also includes a plurality of downturned ribs 56.

In accordance with the invention, a polypropylene hinge extrusion denoted generally by the reference numeral 62 is engaged in the channels 54, 60. The hinge extrusion 62 includes a pair of legs 64 joined together by a top web 66. The web 66 includes an axial thinned zone comprising a fold line living hinge 68. A plurality of mating ribs are formed along inner surfaces of the legs 64. To assemble the mount 14, the legs 64 are received in the channels 60, 54 of the leaves 18, 20 by engaging the channels from an endwise direction.

It should be appreciated that because the magnetic sign mount 14 is constructed of plastic extrusions which are cut to size it may be easily fabricated to accommodate any desired placard width. Further, the polypropylene hinge extrusion 62 is formed to provide easy hinge action with extended fatigue strength while the leaf extrusions 18, 20 are formed of a relatively rigid plastic such as, for example, ultraviolet stable styrene, rigid polyvinyl chloride or acrylonitrile butadiene styrene which are more readily suited for receiving direct imprints, for example the imprinted sign 50, and also provide a surface which is more readily adherable by the adhesive tapes 22 and the magnetic strip mounting adhesives 34 and 40.

Attention is now directed to FIGS. 6 and 7 wherein an alternate embodiment of the invention is illustrated. In this embodiment, like numerals will be employed to designate like components of the previous embodiment, however bearing the suffix "a". In the embodiment a magnetic mount **14*a* is provided for relatively small signs adapted to be suspended from shelf edges. The magnetic sign mount 14*a* includes a relatively rigid front leaf 18*a* and a relatively rigid rear leaf 20*a*. The leaves 18*a*, 20*a* are joined together adjacent their upper edges by a top web 66*a* having an axial living hinge fold 68*a***.

Adjacent the upper and lower edges of the front leaf **18*a* are a pair of facing lips 44*a*, 46*a*, respectively. Carried between the lips is a card sign 48*a* illustrated in FIG. 7. A magnet strip 38*a*, 32*a* is secured to the inner face of each leaf 18*a*, 20*a* respectively adjacent their lower edges. In this embodiment the front leaf 18*a*, the rear leaf 20*a* and the hinge comprising the top web 66*a* and the living hinge line 68*a*** are all formed as a single extrusion.

For the purpose of securing the magnetic sign mount **14*a* to a shelf edge molding channel 70*a* of conventional design, a pair of diverging generally planar webs 72*a*, 74*a* extend from the outer face of the rear leaf 20*a*. The webs 72*a*, 74*a* include diverging flukes 76*a* which are retained between upper and lower inturned edges of the shelf edge molding channel 70*a*. The webs 72*a*, 74*a* may be engaged in the shelf molding 70*a* by being compressed toward one another, being inserted between the inturned channel edges and then being permitted to spring apart. Upon the spreading of the webs, the flukes 60*a*** lock into the inturned channel edges.

It should be noted that the magnetic sign mount **14*a* is adapted to carry a small placard 16*a* which may convey information with respect to items carried on a shelf 78*a* to which the shelf molding 70*a* is attached or items carried on a shelf beneath the shelf 78*a***.

In addition, the card sign **48*a* may carry general advertising information such as indicia converging the merchant, information relating to the product on the shelf 78*a*, or information relating to a different product sold by the provider of the mount 14*a*. As with the prior embodiment, in lieu of a card sign 48*a* a sign 50*a* (FIG. 6) may be imprinted directly on the outer face of the front leaf 18*a***.

Illustrated in FIG. 8 is a further embodiment of the magnetic sign mount having a modified hinge structure. In this embodiment like numerals will be employed to denote like components of the previous embodiments, however bearing the suffix "b".

A magnetic sign mount **14*b* is constructed similar to that of the first embodiment, however in lieu of the separate hinge extrusion 62 each of a pair of leaf extrusions 18*b*, 20*b* include integrally formed mutually interlocking hinge components and the mount 14*b*** is assembled by registering the hinge components along a common axis and sliding the mating leaves together from an endwise direction.

FIG. 8 illustrates only the upper ends of each leaf **18*b* and 20*b*. Pursuant to the invention, formed along the upper edge of the rear leaf 20*b* is a cylindrical sleeve 80*b*** having an open area comprising an arc of approximately 90 degrees.

At the upper edge of the front leaf **18*b*, a horizontal web 82*b* projects toward the rear leaf. The web 82*b* terminates at a cylindrical rod 84*b*. The open area of the sleeve 80*b* permits rotation of the front leaf 18*b*** from a closed position to a horizontal position for insertion and removal of placards.

It should be generally noted that placards may be easily suspended to the mounts by rotating the hinged leaves thus separating the magnet strips, inserting an appropriate placard between the magnet strips—preferably by abutting the upper edge of the placard against the stop rib for positioning purposes and thereafter closing the front leaf to place the front leaf magnet strip 38 in registration with the rear leaf magnet strip 32. The magnetic attraction between the two strips serves to securely retain the placard. In addition, the rigid leaves serve to provide further areas for supporting and/or carrying signs which, due to the limited placard space covered by the magnet, doe not interfere with placard space available for advertising indicia.

Thus, it will be seen that there is provided a magnetic sign mount which achieves the various considerations, features and aspects of the present invention and which is well suited to meet the conditions of practical usage.

As various changes might be made in the invention as above set forth, it is to be understood that all matter herein described or shown in the accompanying drawings is to be interpreted as illustrative and not in a limiting sense.

Having thus described the invention, there is claimed as new and desired to be secured by Letters Patent:

1. An extruded thermoplastic mount for suspending placard signs comprising a front, generally planar, substantially rigid leaf and a rear, generally planar, substantially rigid leaf, each leaf having an upper and a lower edge and an inner and an outer face, hinge means pivotally joining the leaves adjacent their upper edges, the leaves being movable about the hinge means from an open position wherein the inner faces of the leaves are separated from one another to a closed position wherein the inner faces of the leaves are substantially juxtaposed, the outer face of the rear leaf including means for attaching the mount to a support surface, a first magnetic means secured to the inner face of the rear leaf and a second magnetic means secured to the inner face of the front leaf, the magnetic means being in registration when the leaves are in their closed position, the magnetic means engaging a placard sign placed between the magnetic means to suspend the placard sign when the leaves are in their closed position, abutment means for positioning the placard sign, the abutment means being spaced above the magnetic means and extending uninterruptedly throughout the length of the leaves from the inner face of the rear leaf toward the front leaf a distance greater than the thickness of the first magnetic means, the abutment means being engaged by the top edge of the placard sign when the placard sign is positioned between the magnetic means the front leaf further including means for mounting a card sign to its outer face, the mounting means comprising a pair of spaced opposed facing channels, the card sign being dimensioned to be slidably received between the channels.

2. A magnetic mount for suspending placard signs constructed in accordance with claim 1 wherein the front and rear leaves comprise separate extrusions.

3. A mount for suspending placard signs constructed in accordance with claim 1 wherein the means for attaching the mount to a support surface comprises a double faced adhesive tape.

4. A magnetic mount constructed in accordance with claim 1 wherein the sign indicia is imprinted on the outer face of the front leaf.

5. A magnetic mount constructed in accordance with claim 1 wherein the outer face of the rear leaf carries sign indicia.

6. An extruded thermoplastic mount for suspending placard signs comprising a front, generally planar and a rear, generally planar, substantially rigid leaf, each leaf having an upper and a lower edge and an inner and an outer face, hinge means pivotally joining the leaves adjacent their upper edges, the leaves being movable about the hinge means from an open position wherein the inner faces of the leaves are separated from one another to a closed position wherein the inner faces of the leaves are substantially juxtaposed, a first magnetic means secured to the inner face of the rear leaf and a second magnetic means secured to the inner face of the front leaf, the first and second magnetic means being in registration when the leaves are in their closed position and engaging a placard sign placed between the magnetic means to suspend the placard sign in a desired position, the mount further including means for attaching the mount to a support surface, the support surface comprising a shelf edge molding having top and bottom inturned longitudinal edges, the means for attaching the mount to the support surface comprising pair of means for engagement with the inturned edges of the molding, and a pair of webs, each web extending between one engagement means and the rear leaf, the engagement means being spaced apart from one another a distance greater than the distance between the inturned edges, the engagement means being resiliently compressed toward one another when in engagement with the inturned edges of the molding, the front leaf further including means for mounting a card sign to its outer face, the mounting means comprising a pair of spaced opposed facing channels, the card sign being dimensioned to be slidably received between the channels.

7. A mount for suspending placard signs constructed in accordance with claim 6 wherein the outer face of the front leaf carries sign indicia imprinted directly thereon.

8. A mount for suspending placard signs comprising a front leaf and a rear leaf, both leaves being generally planar and substantially rigid, each leaf having an upper and a lower edge and an inner and an outer face, hinge means pivotally joining the leaves adjacent their upper edges, the leaves being movable about the hinge means from an open position wherein the inner faces of the leaves are separated to a closed position wherein the inner faces of the leaves are substantially juxtaposed, the outer face of the rear leaf including means for adhesively attaching the mount to a support surface, a first magnetic means secured to the inner face of the rear leaf and a second magnetic means secured to the inner face of the front leaf, the magnetic means being in registration when the leaves are juxtaposed and engaging a placard sign placed between the magnetic means to suspend the sign in a desired position when the leaves are closed, each leaf comprising a separate plastic extrusion, the hinge means comprising a further plastic extrusion, the hinge means extrusion including a pair of legs and a web interconnecting the legs, the web including a fold line for unitary bending, the fold line comprising a hinge axis, means forming a channel in each of the leaves adjacent the upper edge, one of the legs of the hinge extrusion being seated in each of the channels the hinge extrusion being formed of polypropylene and the leaves being formed of a material having a surface suitable for facilitating adhesive attachment.

9. A magnetic mount constructed in accordance with claim 8 wherein the leaves are formed of a material selected from a group consisting of rigid polyvinylchloride, ultraviolet stable styrene and acrylonitrile butadiene styrene.

10. A magnetic mount constructed in accordance with claim 8 wherein the outer face of the front leaf carries sign indicia.

11. A magnetic mount constructed in accordance with claim 10 wherein the sign indicia is imprinted on the outer face of the front leaf.

12. A magnetic mount constructed in accordance with claim 10 further including a card sign, the sign indicia being positioned on the card sign, the front leaf further including means for mounting the card sign to the outer face.

13. A magnetic mount constructed in accordance with claim 8 wherein the outer face of the rear leaf carries sign indicia.

14. A mount for suspending placard signs comprising a front leaf and a rear leaf, both leaves being generally planar and substantially rigid, each leaf having an upper and a lower edge and an inner and an outer face, hinge means pivotally joining the leaves, the leaves being movable about the hinge means from an open position wherein the inner faces of the leaves are separated to a closed position wherein the inner faces of the leaves are substantially juxtaposed, the outer face of the rear leaf including means for attaching the mount to a support surface, a first magnetic means secured to the inner face of the front leaf, the magnetic means being in registration when the leaves are in the closed position and engaging a placard sign placed between the magnetic means to suspend the sign in a desired position, the hinge means comprising an elongate slit cylinder on one of the leaves and an elongate rod on the other leaf, the rod being engaged in the cylinder the front leaf further including means for mounting a card sign to its outer face, the mounting means comprising a pair of spaced opposed facing channels, the card sign being dimensioned to be slidably received between the channels.

15. A magnetic mount in accordance with claim 14 wherein the outer face of the front leaf carries sign indicia.

* * * * *